US008988454B2

(12) United States Patent
Lebowsky et al.

(10) Patent No.: US 8,988,454 B2
(45) Date of Patent: Mar. 24, 2015

(54) METHOD FOR PROCESSING A DIGITAL VIDEO STREAM AND CORRESPONDING DEVICE

(75) Inventors: Fritz Lebowsky, Saint Martin D'Uriage (FR); Sebastien Marsanne, Meylan (FR)

(73) Assignee: STMicroelectronics (Grenoble 2) SAS, Grenoble (FR)

( * ) Notice: Subject to any disclaimer, the term of this patent is extended or adjusted under 35 U.S.C. 154(b) by 1184 days.

(21) Appl. No.: 12/258,168

(22) Filed: Oct. 24, 2008

(65) Prior Publication Data

US 2009/0135299 A1 May 28, 2009

(30) Foreign Application Priority Data

Oct. 25, 2007 (FR) ..... 07 58583

(51) Int. Cl.

| | |
|---|---|
| ***G09G 5/02*** | (2006.01) |
| ***G09G 5/04*** | (2006.01) |
| ***G09G 5/00*** | (2006.01) |
| *G09G 3/20* | (2006.01) |

(52) U.S. Cl.

CPC ..... *G09G 5/04* (2013.01); *G09G 5/005* (2013.01); *G09G 3/2003* (2013.01); *G09G 5/026* (2013.01); *G09G 2300/0452* (2013.01); *G09G 2310/0275* (2013.01); *G09G 2310/0297* (2013.01); *G09G 2340/02* (2013.01)

USPC ..... 345/604; 345/589; 345/600; 345/603; 345/613; 345/694; 345/100; 345/103

(58) Field of Classification Search

None

See application file for complete search history.

(56) References Cited

U.S. PATENT DOCUMENTS

| | | | | |
|---|---|---|---|---|
| 4,701,790 | A | 10/1987 | Yamada | |
| 6,262,744 | B1 | 7/2001 | Carrein | |
| 6,536,904 | B2 | 3/2003 | Kunzman | |
| 6,633,302 | B1 | 10/2003 | Ohsawa et al. | |
| 6,992,683 | B2 | 1/2006 | Shin et al. | |
| 7,075,554 | B2 * | 7/2006 | Kagawa et al. | 345/600 |
| 7,113,152 | B2 | 9/2006 | Ben-David et al. | |
| 7,545,395 | B2 * | 6/2009 | Kurumisawa | 345/690 |
| 7,586,497 | B2 * | 9/2009 | Boroson et al. | 345/590 |

(Continued)

FOREIGN PATENT DOCUMENTS

| | | |
|---|---|---|
| EP | 1 320 253 A2 | 6/2003 |
| GB | 1 228 878 | 4/1971 |

(Continued)

OTHER PUBLICATIONS

Colantoni et al. "Color Space Transformations." 2004. Accessed via web @ http://colantoni.nerim.net/download/colorspacetransform-1.0.pdf.*

French Search Report dated Jun. 26, 2008 in connection with French Patent Application No. 0758583.

*Primary Examiner* — Antonio A Caschera

(74) *Attorney, Agent, or Firm* — Allen, Dyer, Doppelt, Milbrath & Gilchrist, P.A.

(57) ABSTRACT

A digital video stream of color images intended to be displayed on a matrix screen is formed of macropixels having at least four subpixels each. During processing, the color components of each image are transformed into an RGB format based on a polygonal representation of the color components and designed for the display of images using at least four colors by activating the four subpixels. The color components of the image are adapted in the course of the transformation.

19 Claims, 9 Drawing Sheets

(56) References Cited

U.S. PATENT DOCUMENTS

| | | | | |
|---|---|---|---|---|
| 7,598,961 | B2 * | 10/2009 | Higgins | 345/589 |
| 2004/0051724 | A1 | 3/2004 | Elliott et al. | |
| 2005/0083352 | A1 | 4/2005 | Higgins | |
| 2005/0264587 | A1 | 12/2005 | Kurumisawa | |
| 2007/0115272 | A1 * | 5/2007 | Huang | 345/204 |

FOREIGN PATENT DOCUMENTS

| | | |
|---|---|---|
| JP | 06311355 | 11/1994 |
| WO | 2006111897 A1 | 10/2006 |

* cited by examiner

METHOD FOR PROCESSING A DIGITAL VIDEO STREAM AND CORRESPONDING DEVICE

CROSS-REFERENCE TO RELATED APPLICATIONS

The present application is related to French Patent Application No. 07-58583, filed Oct. 25, 2007, entitled "METHOD FOR PROCESSING A DIGITAL VIDEO STREAM AND CORRESPONDING DEVICE". French Patent Application No. 07-58583 is assigned to the assignee of the present application and is hereby incorporated by reference into the present disclosure as if fully set forth herein. The present application hereby claims priority under 35 U.S.C. §119(a) to French Patent Application No. 07-58583.

TECHNICAL FIELD

The present disclosure relates, in a general manner, to the processing of color digital images with a view to display on a matrix screen, that is, a screen consisting of rows and columns. These screens are preferably flat, active-matrix screens.

The present disclosure relates more particularly to images represented in a format called standard RGB or having been transformed into this format.

BACKGROUND

Conventionally, images delivered by a video processor are processed by a display processing unit (DPU), then transmitted to a means of controlling the columns of the screen incorporated into a means of electronically controlling the display (DDE, for display driver electronics).

U.S. Pat. No. 6,930,691 in the name of STMicroelectronics Inc. describes a transformation of color components of a digital image from a standard RGB format to another RGB format based on a polygonal representation.

This transformation allows an image to be displayed using six colors: yellow, red, green, blue, cyan and magenta. This six-color image display is carried out on a suitable screen. However, the quality of the displayed image is not straightforwardly reproducible from one screen to another.

Furthermore, the display of an image on a matrix screen formed of macropixels having at least four subpixels each and with an independent signal for each subpixel, according to the same mode of control as a matrix screen formed of macropixels having three subpixels each with the colors red, green and blue, in particular with three independent signals, would generate proportionally increased power dissipation, proportionally increased bandwidth and proportionally increased electromagnetic interference.

This would become unacceptable for screens of large size or High Definition (HD) format screens, for example of 1920×1080 macropixels, or even for the small screens of portable systems for which the power dissipation constraints are compounded.

SUMMARY

According to one embodiment, a method is proposed comprising a transformation of an image from a first into a second RGB format based on a polygonal representation, allowing an excellent quality image to be obtained no matter which display screen is used.

According to a first aspect, a method is proposed for processing a digital video stream of color images intended to be displayed on a matrix screen formed of macropixels having at least four subpixels each, each of the images comprising three color components in a first RGB format, the method comprising a transformation of the color components of each image into a second RGB format based on a polygonal representation of the color components and designed for the display of images using at least four colors by activating the four subpixels.

According to a general feature of this method, the color components of the image are adapted in the course of the transformation.

Thanks to the adaptation of the color components of the image, it is possible to adapt the color components to the technical characteristics of a processing system incorporating the method.

In one implementation, the RGB components for each image are transformed based on the equations:

$$CR=f_1(R,G,B,\Delta_1),$$

$$CG=f_2(R,G,B,\Delta_2), \text{ and}$$

$$CB=f_3(R,G,B,\Delta_3)$$

where:

CR, CG and CB are the transformed RGB components;

$f_1$, $f_2$, and $f_3$ are the functions for transformation into the second RGB format for each RGB component;

R, G and B are the three color components in the first RGB format of the image; and $\Delta_1$, $\Delta_2$ and $\Delta_3$ are parameters representing the technical characteristics of a processing system implemented to display the images, for each transformed component of the image considered.

According to another feature of this method, it furthermore comprises, for each image, working out a control signal for each column of the screen based on the transformed color components, each control signal comprising at least four distinct components to activate the corresponding subpixels.

For example, each control signal is capable of activating six subpixels to display six colors, that is:

three main colors: red, green, blue, and three secondary colors: yellow, cyan, magenta.

It should be noted, however, that the choice of color coordinates in the RGB format is in no way limiting. In other words, the color yellow can, for example, resemble every shade between the colors red and green.

For example, for each image at the end of the transformation the procedure is:

encoding then transmission of each of its transformed color components;

reception then decoding of each of its transformed color components; then working out the control signals for the columns of the screen, the working out comprising:

- working out the control signal component to activate the subpixel corresponding to the color yellow by finding the minimum among the received and decoded red and green color components;
- working out the control signal component to activate the subpixel corresponding to the color cyan by finding the minimum among the received and decoded green and blue color components; and
- working out the control signal component to activate the subpixel corresponding to the color magenta by finding the minimum among the received and decoded red and blue color components.

In one implementation, the method furthermore comprises for each image at the end of the transformation:

determination on the basis of the three transformed color components, forming three main color components, of three secondary color components;

a first encoding of the three main color components, in the course of which each main color component is associated with a secondary piece of information representing the value of at least one secondary color component;

a second encoding and transmission of the encoded three main color components according to a standard called PPDS (Point to Point Differential Signalling);

reception of the encoded three main color components and decoding of the main color components received, in the course of which each piece of secondary information is read so as to generate a secondary signal representing the secondary color components;

the working out of the control signal for the columns of the screen then comprising:

working out the control signal component to activate the subpixel corresponding to the color yellow by using the adapted secondary signal to select the minimum among the received and decoded red and green color components;

working out the control signal component to activate the subpixel corresponding to the color cyan by using the adapted secondary signal to select the minimum among the received and decoded green and blue color components;

working out the control signal component to activate the subpixel corresponding to the color magenta by using the adapted secondary signal to select the minimum among the received and decoded red and blue color components.

According to a second aspect, a device for processing a digital video stream is also proposed, comprising a processing system connected to a matrix display screen formed of macropixels having at least four subpixels each, the video stream being formed of color images, each comprising three color components in a first RGB format, the processing system comprising a means of transforming the color components of each image into a second RGB format based on a polygonal representation of the color components, such that the display screen is capable of displaying images using at least four colors resulting from the activation of four subpixels.

According to a general feature of this device, the transformation means includes means for adapting the color components of each image to the technical characteristics of the processing system.

For example, the transformation means comprises three modules respectively associated with three transformation functions, each module being able to transform an RGB component of an image from the first to the second format, such that:

$$CR=f_1(R,G,B,\Delta_1),$$

$$CG=f_2(R,G,B,\Delta_2), \text{ and}$$

$$CB=f_3(R,G,B,\Delta_3)$$

where:

CR, CG and CB are the RGB components transformed by each of the modules;

$f_1$, $f_2$, and $f_3$ are the transformation functions;

R, G and B are the three color components in the first RGB format of the image considered; and $\Delta_1$, $\Delta_2$ and $\Delta_3$ are parameters representing the technical characteristics of the processing system, for each transformed component of the image considered.

This device may furthermore comprise a means for controlling the columns of the matrix screen, able to work out a control signal for each column of the screen based on the transformed color components, each control signal comprising at least four components to activate the corresponding subpixels.

For example, each control signal comprises six components so as to activate six subpixels for the display of six colors, that is:

three main colors: red, green, blue, and three secondary colors: yellow, cyan, magenta.

The processing system may comprise:

a processing unit that incorporates the transformation means and a transmission means able to encode and to transmit each of the transformed color components;

a means for controlling the display which comprises:

a reception means able to receive and to decode each of the transformed color components; and the means of controlling the columns of the matrix screen, connected at the output of the reception means, comprising:

a first sub-means capable of working out the control signal component to activate the subpixel corresponding to the color yellow, by finding the minimum among the red and green color components received and decoded;

a second sub-means capable of working out the control signal component to activate the subpixel corresponding to the color cyan, by finding the minimum among the green and blue color components received and decoded; and a third sub-means capable of working out the control signal component to activate the subpixel corresponding to the color magenta, by finding the minimum among the red and blue color components received and decoded.

According to another characteristic of the device, the processing system may comprise:

a processing unit which incorporates:

the conversion means;

an intermediate unit connected at the output of the transformation means, able to determine on the basis of the three transformed color components, forming three main color components, three secondary color components;

a transmission means capable of encoding the three main color components, in particular by associating them with a secondary piece of information representing the value of at least one secondary color component, and able to transmit the encoded three main color components according to a standard called PPDS;

a means for controlling the display which comprises:

a reception means able to receive the encoded three main color components, and able to decode the main color components received, by reading each piece of secondary information so as to generate a secondary signal representing the secondary color components; and the means of controlling the columns of the matrix screen, connected at the output of the reception means, comprising:

a first selector capable of working out the control signal component to activate the subpixel corresponding to the color yellow by using the corresponding secondary signal to select the minimum among the decoded red and green color components;

a second selector capable of working out the control signal component to activate the subpixel corresponding to the color cyan by using the corresponding secondary signal to select the minimum among the decoded green and blue color components; and a third selector capable of working out the control signal component to activate the subpixel corresponding to the color magenta by using the corresponding secondary signal to select the minimum among the red and blue color components received and decoded.

According to a third aspect, a system comprising a display screen, for example a television, incorporating a device such as described above is also proposed.

Other technical features may be readily apparent to one skilled in the art from the following FIGURES, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
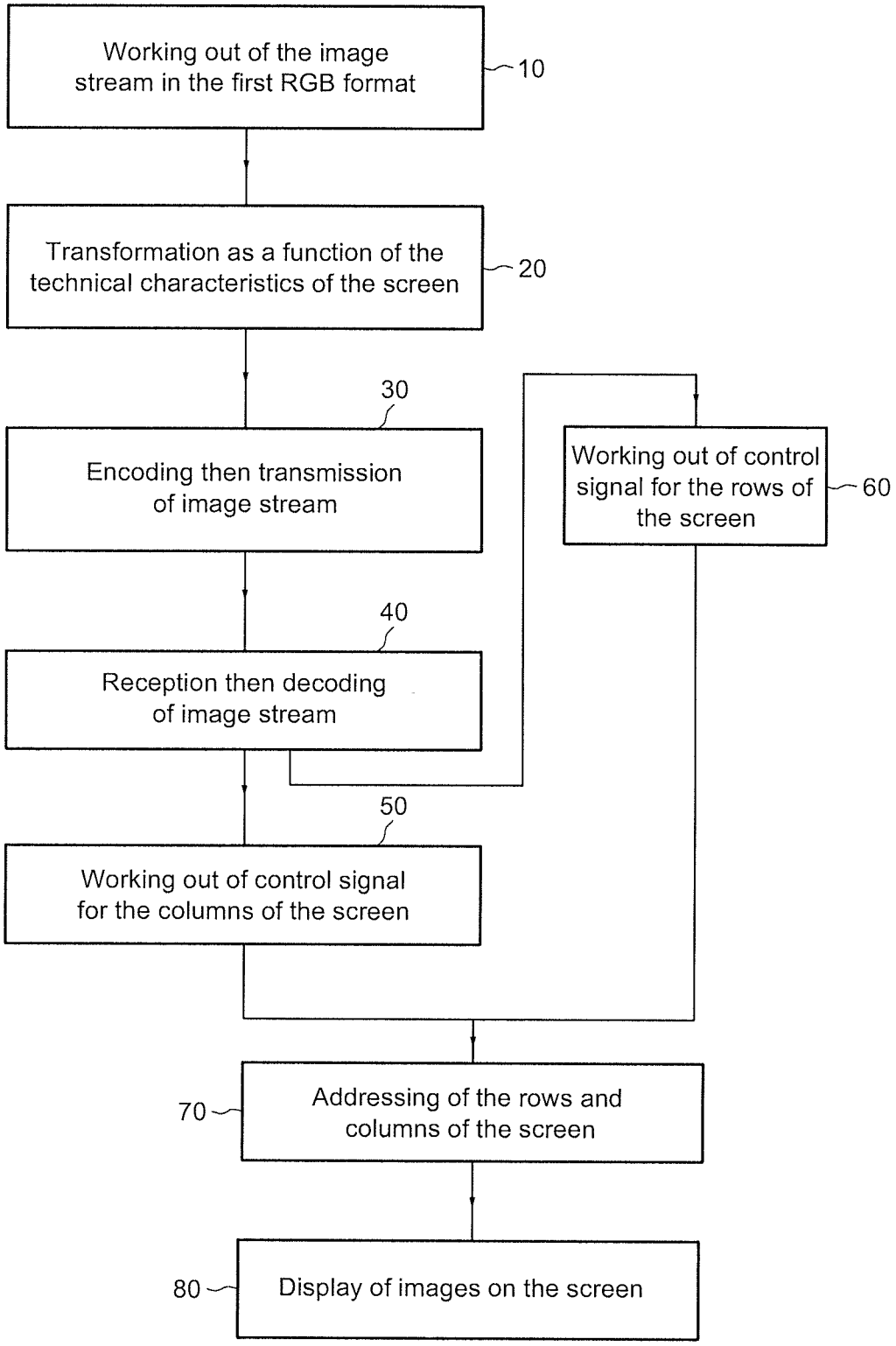
FIG. 1 shows a flow chart illustrating an implementation of the method according to a first aspect.

Reference will be made at present to FIG. 1, which shows, in a very simplified manner, a flow chart which recalls the various steps of a method for processing a video stream according to a first aspect. This video stream is formed of a series of color digital images.

In the course of a first step 10, the image stream is worked out in a first RGB format, for example using a video processor. If this image stream is not in an RGB format, a conversion is first carried out from this other format (for example a YUV format) to an RGB format, referred to as the first RGB format.

This first RGB format is a standard RGB format well known to a person skilled in the art.

The images are then transformed into a second RGB format based on a polygonal representation of the color components (step 20). This second RGB format is described in the patent U.S. Pat. No. 6,930,691 in the name of the applicant.

Besides the steps described in the patent U.S. Pat. No. 6,930,691, this transformation includes an adaptation of the new RGB components to the technical characteristics of the video stream processing system. This is because these technical characteristics tend to impair the brightness of the image, or the saturation of certain colors, or even the shade of certain colors. Adapting the components modifies the new RGB components so as to compensate for an impairment of the image due to technical characteristics of the video stream processing system.

How these technical characteristics are taken into account will be described in more detail below.

In the course of the following step 30, the image stream is encoded and transmitted to be converted into a control signal for the columns of the screen. The encoded images are thus received and then decoded, step 40.

Then the control signal is worked out for each column of the screen (step 50), so as to allow activation of the pixel situated at the intersection of the row and the column considered. The activation of the pixel will be described in more detail subsequently.

In the course of a step 60, in parallel to the step 50 of working out the control signal for the columns of the screen, the control signal for the rows of the screen is worked out. Conventionally, in the case of an active matrix screen, at the moment the image is displayed, the rows of the screen are selected one by one, then for each selected row the control signals will be sent to the columns of the screen so as to display the image considered.

Once the different control signals for the rows and the columns have been worked out, the rows of the screen are addressed row by row, then for each selected row the columns are addressed (step 70).

Finally, once the rows and the columns have been addressed, the image is displayed (step 80).

Figure 2:
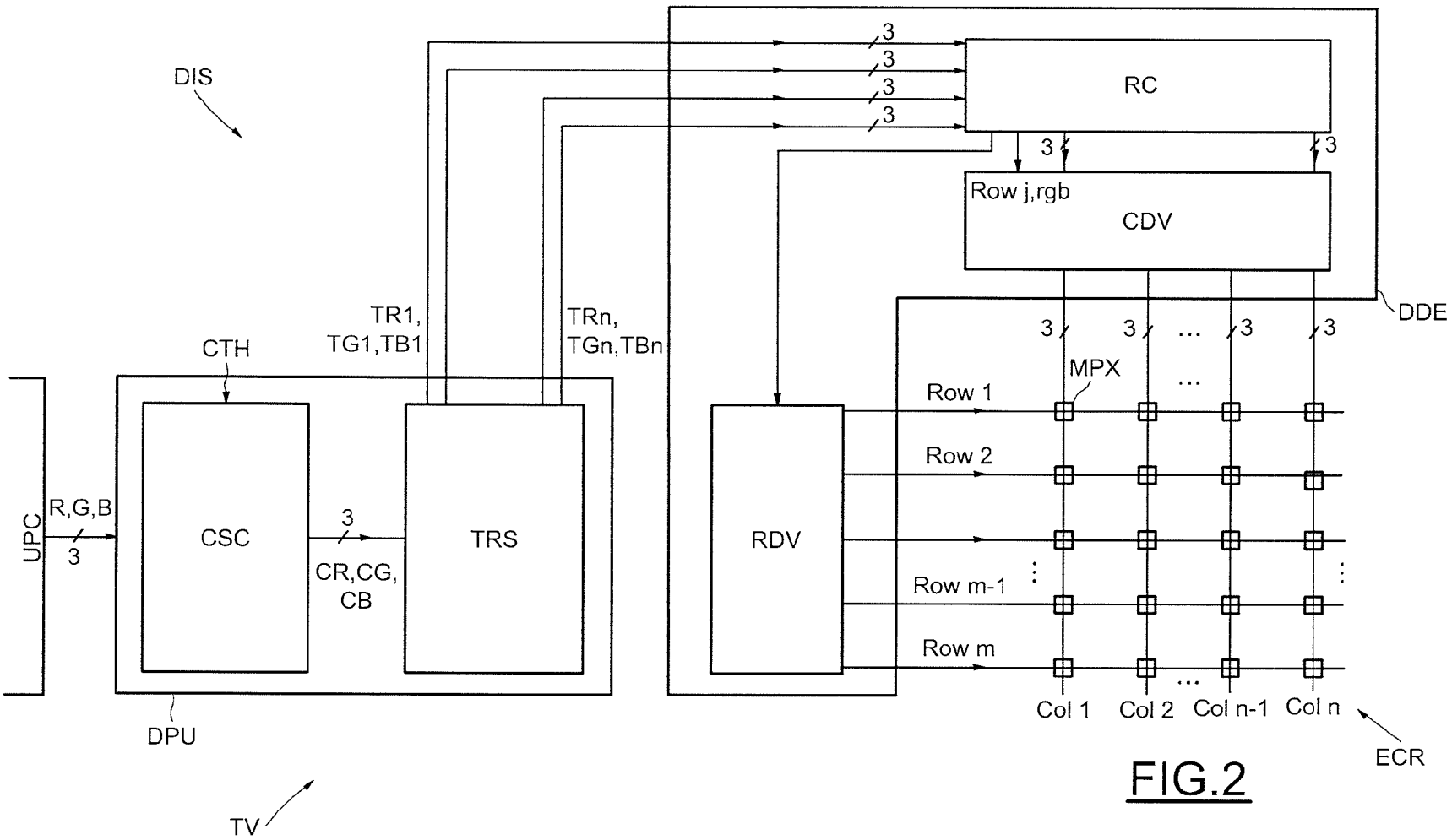
FIG. 2 shows an embodiment of a system incorporating a device according to the second aspect.

Reference will be made at present to FIG. 2, which illustrates a television TV incorporating a matrix screen ECR connected to a digital video stream processing device DIS. The television TV is offered here by way of example. The person skilled in the art will know how to incorporate a digital video stream processing device DIS into any other system having a matrix display screen.

Figure 3B:
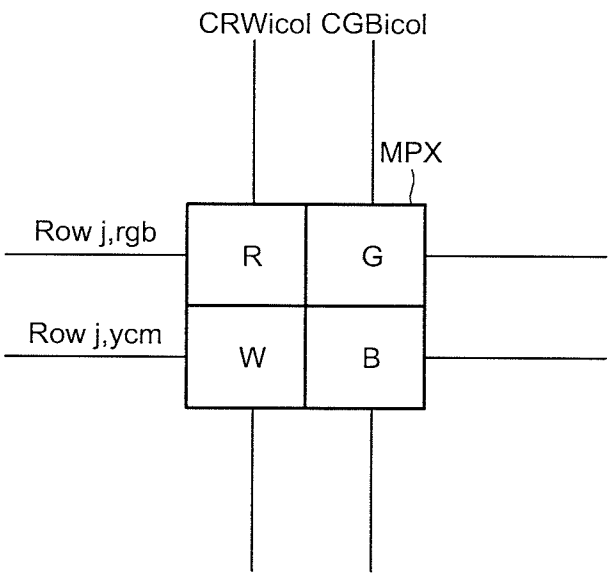
FIG. 3*b* illustrates another example of a macropixel incorporated within the screen, connected to the device illustrated in FIG. 2.
Figure 3A:
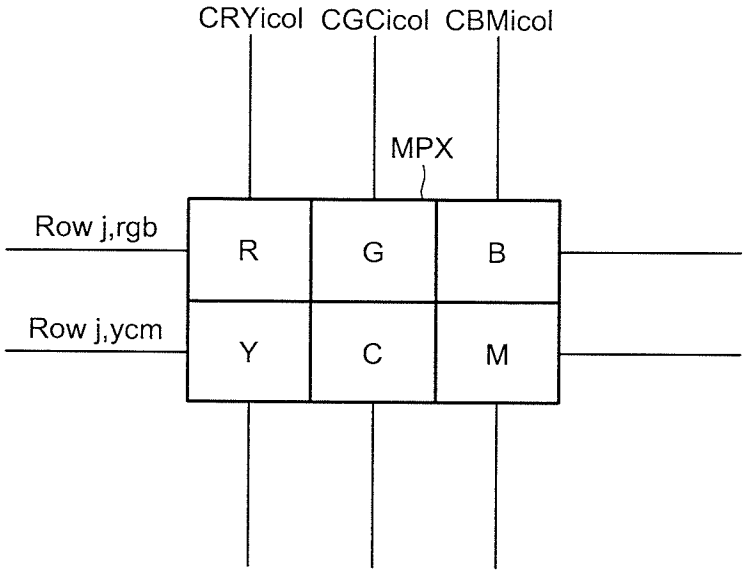
FIG. 3*a* illustrates an example of a macropixel incorporated within the screen, connected to the device illustrated in FIG. 2.

The screen ECR is a matrix screen known as an active matrix screen. It is formed of rows and columns, at the intersection of which a macropixel MPX is situated. This macropixel MPX is represented in FIG. 3*a*. Here it is formed of six parts or subpixels, each allowing the very precise display of one color, respectively red R, green G, blue B, yellow Y, cyan C and magenta M. As can be seen, each macropixel MPX is addressable by control signals row j, rgb; row j, ycm; $CRY_{icol}$; $CGC_{icol}$; and $CBM_{icol}$. The colors red, green and blue are called main colors, while the colors yellow, cyan and magenta are the secondary colors. Generally speaking, a macropixel is formed of at least four subpixels. Thus, the subpixels may also correspond to three main colors to which a white subpixel W is added, as illustrated in FIG. 3*b*. As previously, the macropixels are addressable by control signals, here marked row j, rgb; row j, ycm; $CRW_{icol}$ and $CGB_{icol}$. The use of macropixels instead of standard pixels (with three subpixels for the three main colors) allows optimal image quality with colors close to the real colors.

Referring again to FIG. 2, the device DIS comprises a processing system formed, in particular, of a video processor VPC, a processing unit DPU, and a display control means DDE.

The video processor VPC delivers a digital video stream formed of color images in a standard RGB format. Consequently, each image is formed of three color components, red R, green G and blue B, respectively.

For each image, these three components are delivered to the processing unit DPU.

This processing unit DPU has a transformation means CSC which, besides the color components of images in a standard RGB format, receives data CTH modelling the various technical characteristics of the processing system of the device DIS. More precisely, the data CTH represent the distortion of the image colors caused by the processing system. For example, the choice of optical filter for the color red may cause a modification of the red, green and blue components of the image. Similarly, the choice of optical filter for the color green may cause a modification of the red, green and blue components of the image. The choice of optical filter for the color blue may similarly cause a modification of the red, green and blue components of the image. The choice of optical filter for the color yellow may in addition cause a modification of the red, green and blue components of the image. The choice of optical filter for the color cyan may also cause a modification of the red, green and blue components of the image. The choice of optical filter for the color magenta may similarly cause a modification of the red, green and blue components of the image. In the case where there is no corresponding color filter for the color white, the choice to pass through a white subpixel may cause a modification of the red, green and blue components of the image.

The transformation means CSC transforms the components of each image from the standard RGB format (first RGB format) into a second RGB format based on a polygonal representation of the color components, such as described in the patent U.S. Pat. No. 6,930,691. In addition, this transformation includes an adaptation of the new color components to the various technical characteristics of the processing system, based on the data CTH.

At the output of the transformation means CSC, each image comprises three color components CR, CG and CB in the second RGB format, such as described above, with an additional adaptation to the technical characteristics of the processing system.

For each image, these three components CR, CG and CB are transmitted to a transmission means TRS. The latter is connected to the display control means DDE, which is able to control the columns of the screen ECR, n being the number of columns col 1, . . . , col n of the screen ECR, and the rows row 1, . . . , row m of the screen ECR, m being the number of rows of the screen ECR. The transmission has to transmit only three color components TR1, TG1, TB1, . . . , TRn, TGn, TBn per row, which makes the transmission particularly fast.

The transmission is preferably carried out in a differential mode. For example, the encoding and the transmission may be carried out according to the LVDS (Level Voltage Differential Signalling), or RSDS (Reduced Swing Differential Signalling) or PPDS (Point to Point Differential Signalling) standard, or the like, which are well known to the person skilled in the art.

A receiver RC (reception means) incorporated into the display control means DDE receives the data according to the LVDS (Level Voltage Differential Signalling), or RSDS (Reduced Swing Differential Signalling) or PPDS (Point to Point Differential Signalling) standard, or the like, which are well known to the person skilled in the art. The receiver RC then decodes these data before sending them to a means for controlling the columns of the screen CDV. Note that the reception unit RC also controls a means of controlling the rows of the screen ECR, referred to as RDV, based on the horizontal and vertical synchronization signals, incorporated in the transmission means TRS. The means for controlling the screen RDV includes each subscripted row j (j being between 1 and m).

Based on these three color components, the column control means CDV is able to work out, for each column, a control signal for each macropixel MPX situated in the activated row. An embodiment of the column control means CDV will be described in more detail below.

Figure 4:
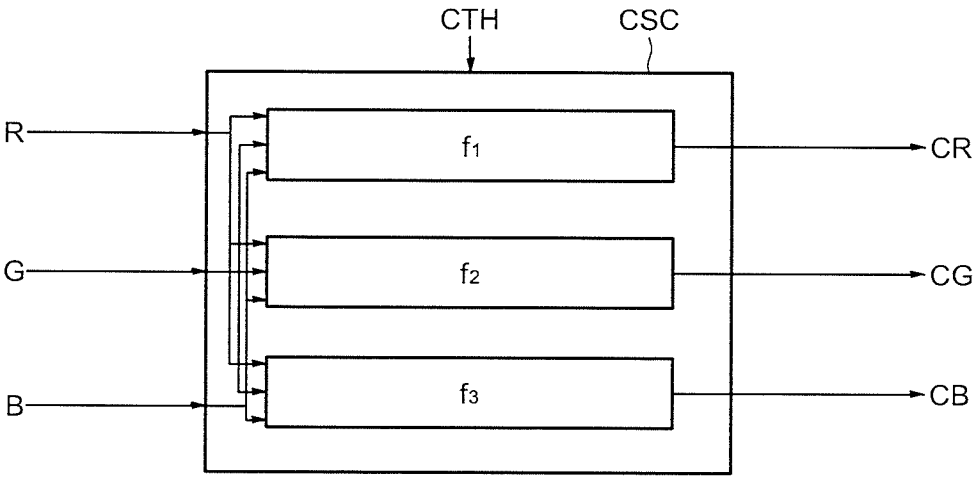
FIG. 4 illustrates an embodiment of a transformation means incorporated in the devices of FIG. 2.

Reference will be made at present to FIG. 4, which illustrates an embodiment of a transformation means CSC. As explained above, for each image of the video stream it receives the three color components R, G and B in a first, standard RGB format.

The transformation means also receives data CTH corresponding to different technical characteristics of the processing system. In this example the data CTH will be considered to represent the variations in brightness generated by the screen used for the different colors making up the displayed images.

The transformation means CSC comprises three modules, each being associated with a function f1, f2 and f3, respectively. The three modules receive the three color components R, G, B in the first RGB format. The module associated with the function f1 provides the transformed red component CR, the module associated with the function f2 provides the transformed green component CG and the module associated with the function f3 provides the transformed blue component CB.

For example, the three transformed components CR, CG and CB may be worked out according to the three following functions:

$$CR=f1(R,G,B,\Delta_1\mathrm{lum}_R,\Delta_1\mathrm{lum}_G,\Delta_1\mathrm{lum}_B,\Delta_1\mathrm{lum}_Y,\Delta_1\mathrm{lum}_C,\Delta_1\mathrm{lum}_M),$$

$$CG=f2(R,G,B,\Delta_2\mathrm{lum}_R,\Delta_2\mathrm{lum}_G,\Delta_2\mathrm{lum}_B,\Delta_2\mathrm{lum}_Y,\Delta_2\mathrm{lum}_C,\Delta_2\mathrm{lum}_M),$$

$$CB=f3(R,G,B,\Delta_3\mathrm{lum}_R,\Delta_3\mathrm{lum}_G,\Delta_3\mathrm{lum}_B,\Delta_3\mathrm{lum}_Y,\Delta_3\mathrm{lum}_c,\Delta_3\mathrm{lum}_M).$$

The variables R, G, B are the color components received by the transformation means CSC, the variables $\Delta_i\mathrm{lum}_X$ correspond to the aforementioned variations in luminosity.

Figure 5A:
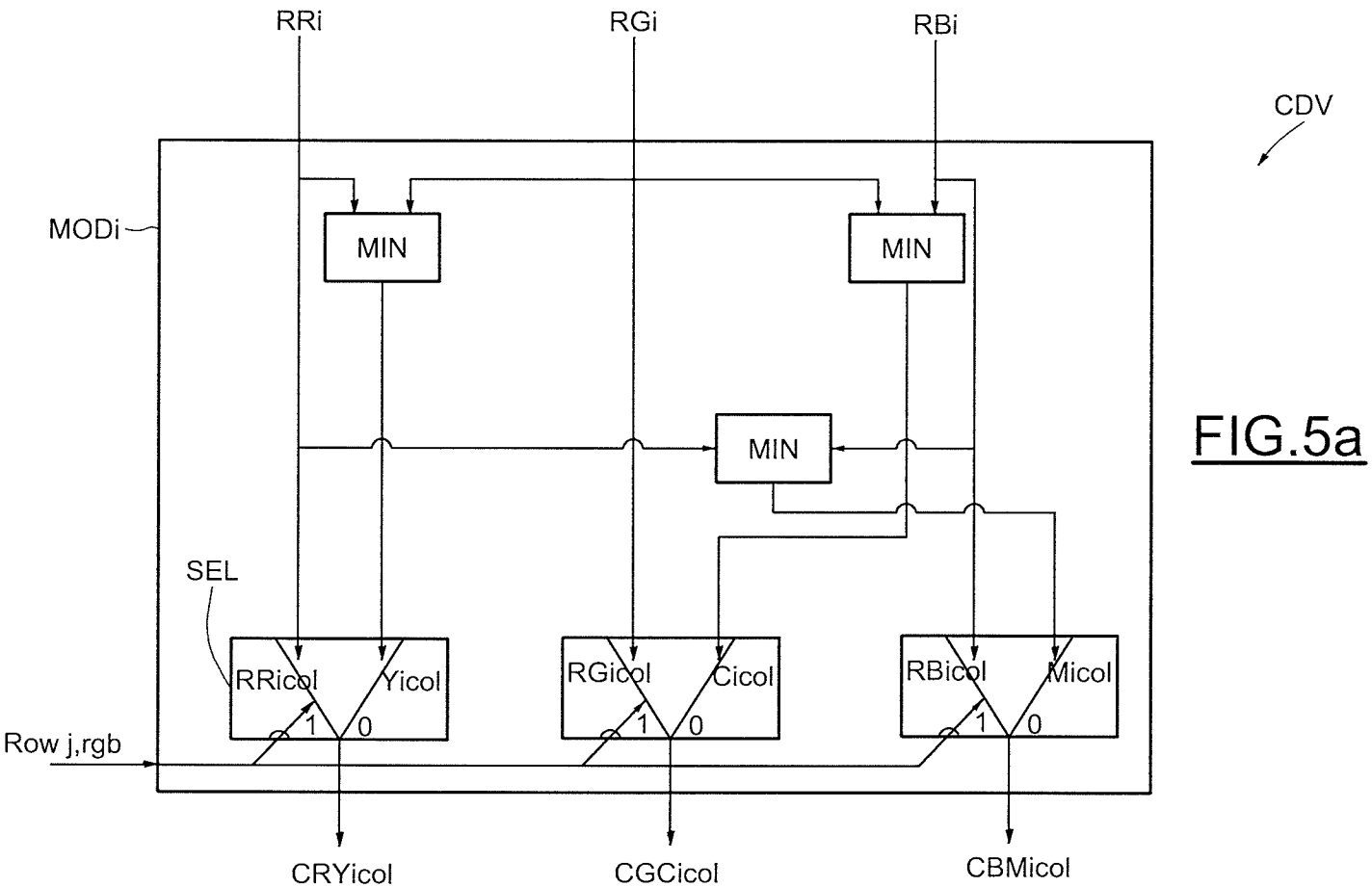
FIG. 5*a* illustrates an embodiment of a means for controlling the columns of a screen such as illustrated in FIG. 2.

Reference will be made at present to FIG. 5*a*, which illustrates an embodiment of the means CDV of controlling the columns of the screen. The screen control means CDV comprises for each subscripted column i (i being between 1 and n) a module MODi able to generate the control signal for the column. Each control signal comprises six components $RR_{iCOL}$, $Y_{iCOL}$, $RB_{iCOL}$, $C_{iCOL}$, $RB_{iCOL}$ and $M_{iCOL}$ to activate respectively the six subpixels of the macropixel, red, yellow, green, cyan, blue and magenta, respectively.

To work out these control signals, the column control means CDV then receives as input the color components of the image in the second RGB format, once these have been decoded by the receiver RC, and stores them with a storage means, preferably a register. The color components decoded by the receiver RC are referred to as RRi, RGi and RBi.

The control signal components for activating the red, green and blue subpixels, $RR_{iCOL}$, $RB_{iCOL}$ and $RB_{iCOL}$ respectively, result directly from the components RRi, RGi and RBi.

The module MODi comprises three units MIN able to choose the minimum between two input values. The first unit MIN (first sub-means) receives the components RRi and RGi as input and generates as output the control signal component $Y_{iCOL}$ which allows the yellow subpixel to be activated. The control signal component $Y_{iCOL}$ therefore corresponds to the minimum between the signals RRi and RGi.

Similarly, another unit MIN (second sub-means) receives the green RGi and blue RBi components as input so as to provide the control signal component $C_{iCOL}$ capable of activating the cyan subpixel.

Finally, a last unit MIN (third sub-means) receives the red RRi and blue RBi components as input and provides as output the control signal component $M_{iCOL}$ capable of activating the magenta subpixel.

A macropixel with six subpixels is preferably defined by means of two rows of three columns of subpixels, as illustrated in FIG. 3*a*. A signal Row j, rgb (the subscript j being between 1 and m) generated in the receiver RC is used to control the selectors SEL (fourth to sixth sub-means). The first unit SEL (fourth sub-means) receives the components $RR_{iCOL}$ and $Y_{iCOL}$ as input and generates as output the component $CRY_{iCOL}$ controlling the red subpixel when the row j, rgb is activated or controlling the yellow subpixel when the row j, ycm is activated.

Similarly, another unit SEL (fifth sub-means) receives the components $RG_{iCOL}$ and $C_{iCOL}$ as input and generates as output the component $CGC_{iCOL}$ controlling the green subpixel when the row j, rgb is activated or controlling the cyan subpixel when the row j, ycm is activated.

Finally, a last unit SEL (sixth sub-means) receives the components $RB_{iCOL}$ and $M_{iCOL}$ as input and generates as output the component $CBM_{iCOL}$ controlling the blue subpixel when the row j, rgb is activated or controlling the magenta subpixel when the row j, ycm is activated.

Figure 5B:
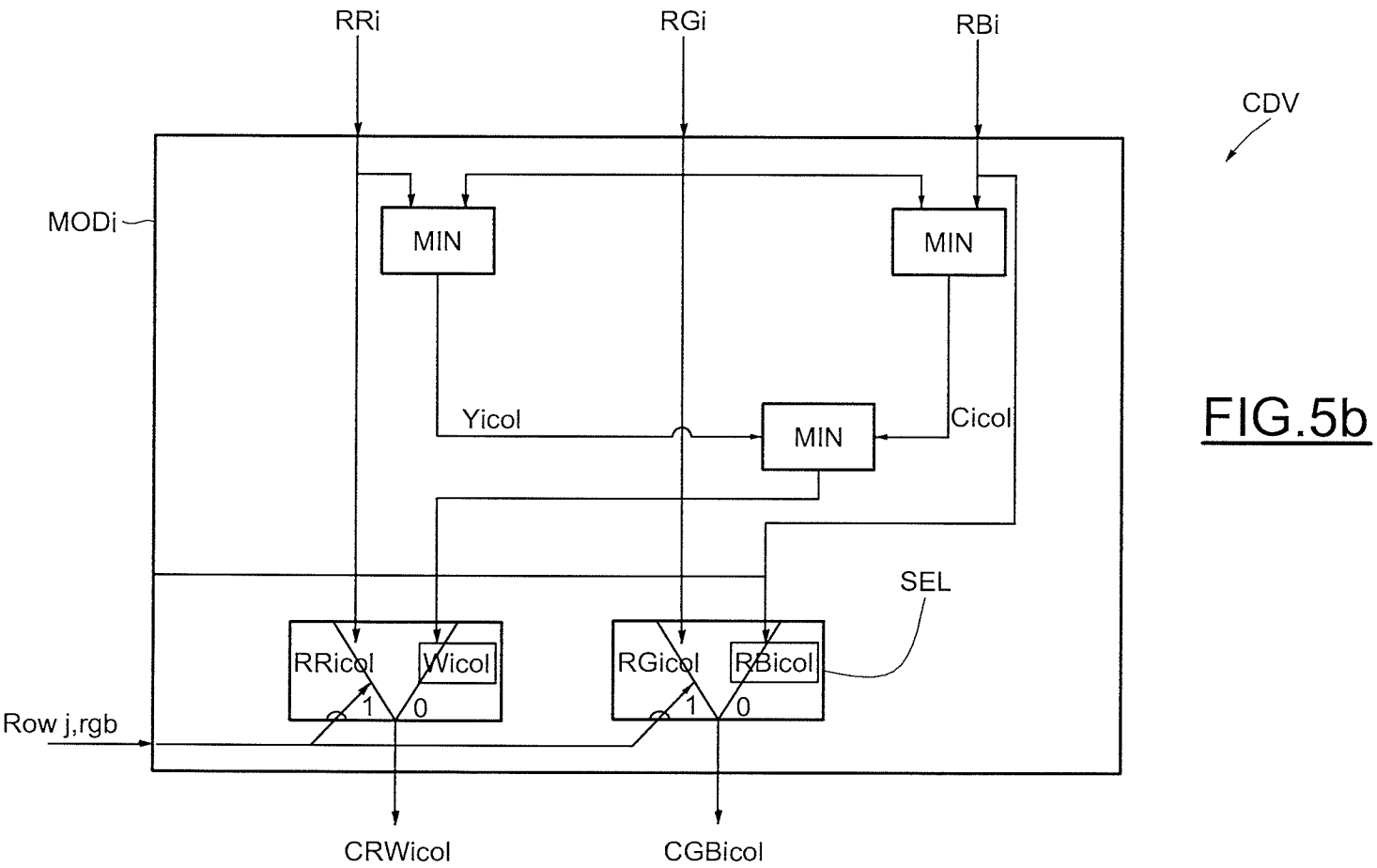
FIG. 5*b* illustrates another embodiment of a means for controlling the columns of a screen such as illustrated in FIG. 2.

Reference will be made at present to FIG. 5*b*, which illustrates another embodiment of the means CDV of controlling the columns of the screen. The screen control means CDV comprises for each subscripted column i (i being between 1 and n) a module MODi able to generate the control signal for the column. Each control signal comprises four components $RR_{iCOL}$, $RB_{iCOL}$, $RB_{iCOL}$ and $W_{iCOL}$ to activate respectively the four subpixels of the macropixel, red, green, blue and white, respectively.

To work out these control signals, the column control means CDV then receives as input the color components of the image in the second RGB format, once these have been decoded by the receiver RC. The color components decoded by the receiver RC are referred to as RRi, RGi and RBi.

The control signal components for activating the red, green and blue subpixels, $RR_{iCOL}$, $RB_{iCOL}$ and $RB_{iCOL}$ respectively, result directly from the components RRi, RGi and RBi.

The module MODi comprises three units MIN able to choose the minimum between two input values. The first unit MIN (first sub-means) receives the components RRi and RGi as input and generates as output the control signal component $Y_{iCOL}$ which allows the yellow subpixel to be activated. The control signal component $Y_{iCOL}$ therefore corresponds to the minimum between the signals RRi and RGi.

Similarly, another unit MIN (second sub-means) receives the green RGi and blue RBi components as input so as to provide the control signal component $C_{iCOL}$ capable of activating the cyan subpixel.

Finally, a last unit MIN (third sub-means) receives the yellow and cyan components $Y_{iCOL}$ and $C_{iCOL}$ as input and provides as output the control signal component $W_{iCOL}$ capable of activating the white subpixel.

A macropixel with four subpixels is preferably composed of two rows of two columns, as illustrated in FIG. 3*b*. A signal Row j, rgb generated in the receiver RC is used to control the selectors SEL (fourth and fifth sub-means). The first unit SEL (fourth sub-means) receives the components $RR_{iCOL}$ and $W_{iCOL}$ as input and generates as output the component $CRW_{iCOL}$ controlling the red subpixel when the row j, rgb is activated or controlling the white subpixel when the row j, ycm is activated.

Similarly, another unit SEL (fifth sub-means) receives the components $RG_{iCOL}$ and $RB_{iCOL}$ as input and generates as output the component $CGB_{iCOL}$ controlling the green subpixel when the row j, rgb is activated or controlling the blue subpixel when the row j, ycm is activated.

Figure 6:
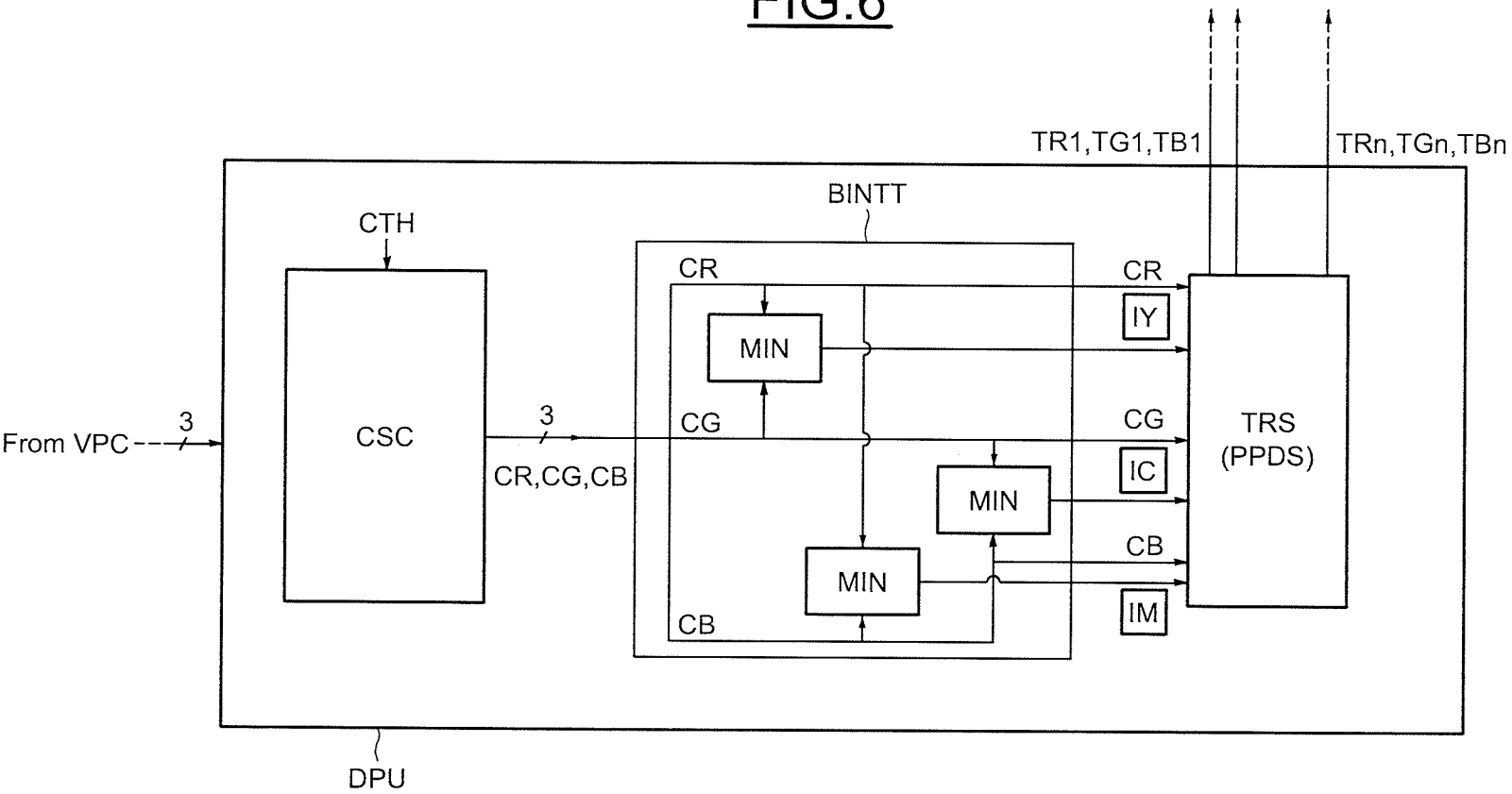
FIG. 6 illustrates another embodiment of a processor such as shown in FIG. 2.
Figure 7:
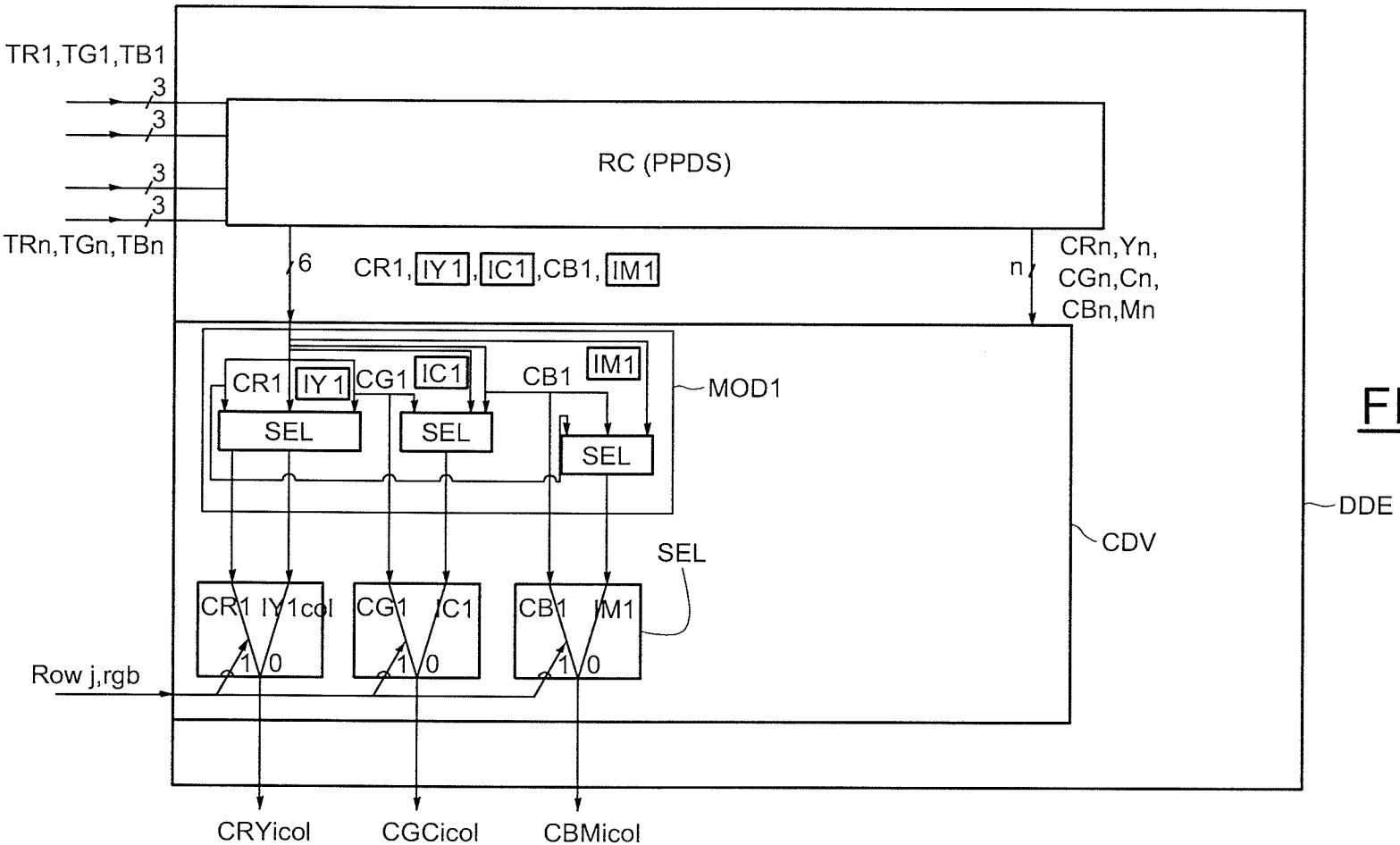
FIG. 7 illustrates an embodiment of a display control means working together with the processor shown in FIG. 6.
Figure 8:
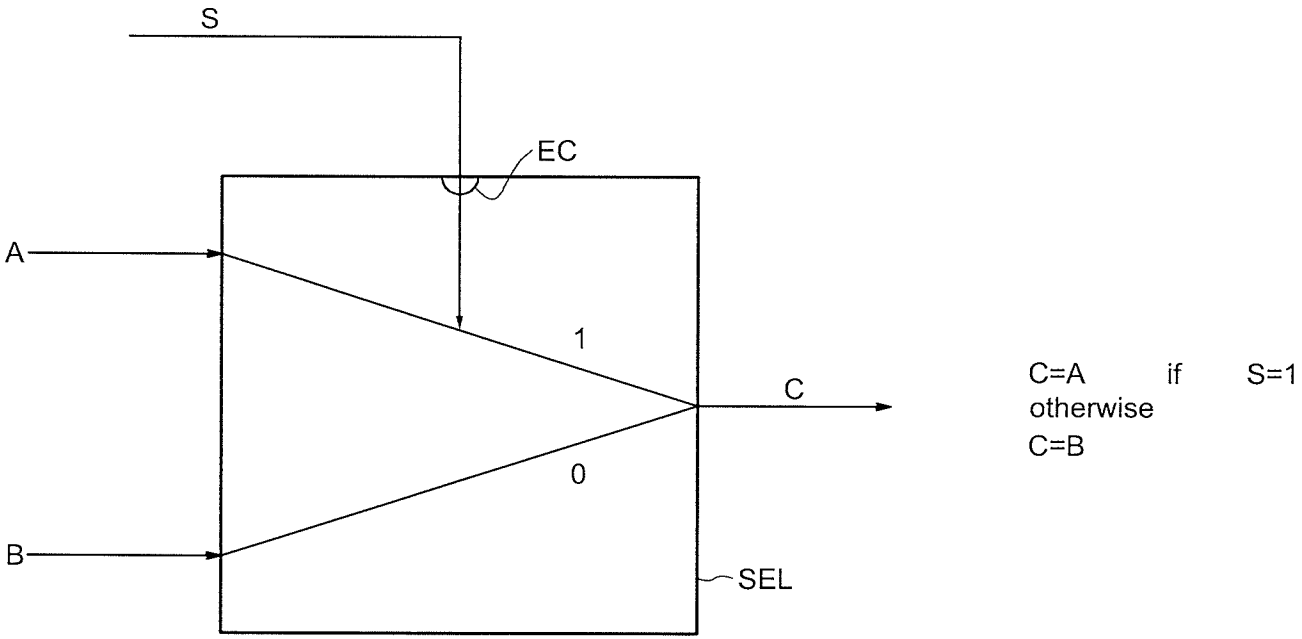
FIG. 8 shows an embodiment of a selector incorporated in a display control means such as shown in FIG. 7.

FIGS. 6 to 8 show variants of the processing system in the case where the transmission is carried out according to the transmission standard called PPDS (Point to Point Differential Signalling).

In this case, the processing unit DPU includes an intermediate unit BINTT connected between the transformation means CSC and the transmission means TRS which is itself adapted to the PPDS standard. For each image this intermediate unit BINTT receives the transformed color components CR, CG and CB as input.

This intermediate unit BINTT comprises three units DMIN so as to generate the information components called information components for secondary colors, IY, IC and IM for yellow, cyan and magenta, respectively.

The secondary color information component IY corresponds to a bit that signals the minimum between the red and green color components CR and CG. The color component IC corresponds to a bit that signals the minimum between the blue and green color components CB and CG. Finally, the color component IM corresponds to a bit that signals the minimum between the red and blue color components CR and CB.

All these color components CR, IY, CG, IC, CB and IM are provided by the transmission means TRS. The latter transmits data TR1, TG1, TB1, . . . , TRn, TGn, TBn to the receiver RC for each column numbered from 1 to n.

Each datum TRi, TGi, TBi respectively corresponds to the three transformed main color components for the column numbered i, to which a secondary piece of information is attached. Although the primary information is composed of several bits, the secondary information corresponds to one or more additional bits allowing the value of a secondary color component to be determined. In this way, if the yellow color component corresponds to the red color component, because the value of this component is less than the green component, then the variables TRi will have, for example, an additional bit equal to one so as to indicate that the yellow secondary color component has the same value as the red main color component. This is carried out for all the columns, for all the components and for all the images.

FIG. 7 illustrates a display control means DDE designed to the PPDS standard. In this case, the receiver RC is itself designed to the PPDS standard. It receives the data TR1, TG1, TB1, . . . , TBn, TGn, TBn as input and provides as output, for each column of the screen, the decoded red, green and blue main color components, CRi, CGi and CBi, respectively, for a column i, along with secondary signals representing the secondary color information components IYi, ICi, IMi for a column i. These secondary signals IYi, ICi, IMi are worked out as a function of the secondary information.

The modules MODi of the column control means CDV hence comprise selectors SEL in place of the units MIN from the embodiment of FIG. 5. For the first column, the selectors SEL of the module MOD1 respectively receive as input the color components red and green, CR1 and CG1, green and blue, CG1 and CB1, and blue and red, CB1 and CR1. Each selector SEL is controlled by a control signal corresponding to the secondary signals IY1, IC1 and IM1, respectively.

Depending on the value of this control signal, the selector chooses one or the other of the color components, such that the yellow, blue and magenta components respectively correspond to the minimum among the red and green components, the green and blue components, and the blue and red components.

The module MODi is repeated for each column and its working mechanism is identical for each of them.

As can be seen in FIG. 7, a selector SEL is again used to choose one or the other of the control signal components, namely CR1 or Ylcol, CG1 or C1, CB1 or M1, to work out the signals, $CRY_{icol}$, $CGC_{icol}$ and $CBM_{icol}$, respectively, for selecting the columns of the macropixel MPX (FIG. 3(*a*)).

FIG. 8 shows an example of a selector SEL incorporated into one of these modules. The latter receives two variables A and B as input, for example the red and blue color components coming from the receiver RC. The selector EC comprises a control input EC which receives the previously mentioned control signal. The latter, worked out from a secondary piece of information, indicates whether the component A is less than or equal to the component B. If that is the case, the input A is connected to the output; if not, the input B is connected to the output. Preferably, for the control signal S a representative binary value is used, as is well known to the person skilled in the art, for example "1", which indicates to the selector to connect the component A to the component C, and to connect the component B otherwise.

It will be noted finally that the previously described device and method apply equally well to fixed screens, of the video screen type, for example television sets or flat screens, as to screens of electronic equipment, whether portable or not, such as microcomputers, mobile telephones, or the like.

They therefore apply in a general manner to systems comprising a display screen in which processing of color digital images is implemented.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method for processing a digital video stream of color images, each color image comprising three color components in a first RGB format, the method comprising:

transforming, by processing circuitry, color components of each color image into three color components of a second RGB format based on the three color components of the first RGB format and three parameters each representing variations in luminosity in one of the three color components of the second RGB format caused by a processing system comprising at least one of a video processor, a display processing unit, and display driver electronics in a display device, the second RGB format for displaying images formed of macropixels using at least four colors by activating at least four subpixels within each macropixel, each macropixel selectably addressable by two row control signals for the respective macropixel and at least two column control signals for a respective macropixel, the three color components for each image being transformed based on:

$$CR=f_1(R,G,B,\Delta_1),$$

$$CG=f_2(R,G,B,\Delta_2), \text{ and}$$

$$CB=f_3(R,G,B,\Delta_3)$$

wherein CR, CG and CB are the transformed RGB components, $f_1$, $f_2$, and $f_3$ are the functions for transformation into the second RGB format for each RGB component, R, G and B are the three color components according to the first RGB format, and $\Delta_1$, $\Delta_2$ and $\Delta_3$ are the three image color distortion parameters representing variations in luminosity caused by technical characteristics of the processing system, for each transformed component of the image; and during the transformation of the color components, adapting the three color components of the image using the three image color distortion parameters to at least four color components.

2. The method according to claim 1, further comprising generating the at least two column control signals for each column of based on the transformed color components.

3. The method according to claim 2, wherein the two row signals and the at least two control signals activate six subpixels to display six colors, the six colors comprising three main colors comprising red, green, blue and three secondary colors comprising yellow, cyan, magenta.

4. The method according to claim 3, further comprising, for each image, following transformation:

encoding each of the transformed color components;

transmitting the encoded transformed color components;

receiving and then decoding each of the transformed color components; and generating the at least two column control signals for columns of a display screen, wherein generating the at least two column control signals comprises generating a first column control signal component to activate a subpixel corresponding to yellow by finding a minimum among received and decoded red and green color components, generating a second column control signal component to activate a subpixel corresponding to cyan by finding a minimum among received and decoded green and blue color components, and generating a third column control signal component to activate a subpixel corresponding to magenta by finding a minimum among received and decoded red and blue color components.

5. The method according to claim 3, comprising, for each image, following transformation:

determining, based on the three transformed color components, three main color components;

during encoding of the three main color components, associating secondary information representing a value of at least one secondary color component with each main color component;

encoding and transmitting the encoded three main color components according to Point-to-Point Differential Signaling (PPDS); and receiving the encoded three main color components and, during decoding the main color components reading each piece of secondary information; and generating a secondary signal representing the secondary color components, wherein generating the at least two column control signals for a column of macropixels comprises generating a first column control signal component to activate a subpixel corresponding to yellow using the secondary signal to select a minimum among the received and decoded red and green color components, generating a second column control signal component to activate a subpixel corresponding to cyan using the secondary signal to select a minimum among the received and decoded green and blue color components, and generating a third column control signal component to activate a subpixel corresponding to magenta using the secondary signal to select a minimum among the received and decoded red and blue color components.

6. The method of claim 1, wherein the transforming color components of each image into three color components of a second RGB format is based on a polyhedral representation of the color components.

7. An apparatus for processing a digital video stream comprising color images, each color image comprising three color components in a first RGB format, the apparatus comprising:

a matrix display screen comprising macropixels having at least four subpixels and configured to display images using at least four colors using the at least four subpixels within each of the macropixels, each macropixel being selectably addressable by two row signals and at least two column signals; and a processing device connected to the matrix display screen and configured to transform the color components of each color image into three color components of a second RGB format based on the color components of the first RGB format and three parameters each representing variations in luminosity in one of the three color components of the second RGB format caused by the processing device, and encode each of the transformed color components, such that the matrix display screen is configured to display each image in the second RGB format, the processing device being configured to transform an RGB component of a color image from the first RGB format to the second RGB format based on:

$$CR=f_1(R,G,B,\Delta_1),$$

$$CG=f_2(R,G,B,\Delta_2), \text{ and}$$

$$CB=f_3(R,G,B,\Delta_3)$$

where CR, CG and CB are the RGB components, $f_1$, $f_2$, and $f_3$ are the transformation functions, R, G and B are the three color components in the first RGB format of each image, and $\Delta_1$, $\Delta_2$ and $\Delta_3$ are the three image color distortion parameters representing variations in luminosity caused by technical characteristics of the processing device.

8. The apparatus according to claim 7, further comprising a display controller coupled to the matrix display screen and configured to control columns of the matrix display screen, and generate the at least two column control signals for each column of macropixels in the matrix display screen based on the transformed color components.

9. The apparatus according to claim 8, wherein the two row signals and at least two column signals comprise six components to activate six subpixels for the matrix display screen of six colors including three main colors consisting of red, green, and blue, and three secondary colors consisting of yellow, cyan, and magenta.

10. The apparatus according to claim 9, wherein the processing device further comprises:

a transmitter configured to encode and to transmit each of the encoded transformed color components; and a display control mechanism configured to control the matrix display screen, the display control mechanism comprising the display controller and a receiver configured to receive and to decode each of the encoded transformed color components, wherein the display controller is connected at an output of the receiver and is configured to generate a first control signal component to activate a subpixel corresponding to yellow by finding a minimum among the red and green color components received and decoded, generate a second control signal component to activate a subpixel corresponding to cyan by finding a minimum among the green and blue color components received and decoded, and generate a third control signal component to activate a subpixel corresponding to magenta by finding a minimum among the red and blue color components received and decoded.

11. The apparatus according to claim 9, wherein the processing device comprises:

an intermediate unit configured to determine, based on the three transformed color components, three main color components and three secondary color components;

a transmitter configured to encode the three main color components by associating secondary information representing a value of at least one secondary color component the three main color components, and to transmit the encoded three main color components according to Point-to-Point Differential Signaling (PPDS); and a receiver configured to receive the encoded three main color components, and to decode the main color components by reading each piece of secondary information to generate a secondary signal representing the secondary color components, wherein the display controller is connected to output of the receiver and further comprises a first selector configured to select the first control signal component and to activate the subpixel corresponding to yellow using the corresponding secondary signal to select a minimum among the decoded red and green color components, a second selector configured to select the second control signal component and to activate the subpixel corresponding to cyan using the corresponding secondary signal to select a minimum among the decoded green and blue color components, and a third selector configured to select the third control signal component and to activate the subpixel corresponding to magenta using the corresponding secondary signal to select a minimum among the red and blue color components.

12. A television set, comprising the apparatus according to claim 8 and the matrix display screen.

13. A video display screen, comprising the apparatus according to claim 8 and the matrix display screen.

14. A microcomputer, comprising the apparatus according to claim 8 and the matrix display screen.

15. A mobile telephone, comprising the apparatus according to claim 8 and the matrix display screen.

16. A television set, comprising the apparatus according to claim 7 and the matrix display screen.

17. A video display screen, comprising the apparatus according to claim 7 and the matrix display screen.

18. A microcomputer, comprising the apparatus according to claim 7 and the matrix display screen.

19. A mobile telephone, comprising the apparatus according to claim 7 and the matrix display screen.

* * * * *